US008727188B2

(12) United States Patent
Hagen

(10) Patent No.: US 8,727,188 B2
(45) Date of Patent: May 20, 2014

(54) DISPENSER

(75) Inventor: Holger Hagen, Lohne (DE)

(73) Assignee: RPC Bramlage GmbH, Lohne (DE)

( * ) Notice: Subject to any disclaimer, the term of this patent is extended or adjusted under 35 U.S.C. 154(b) by 0 days.

(21) Appl. No.: 13/697,165

(22) PCT Filed: May 11, 2011

(86) PCT No.: PCT/EP2011/057572

§ 371 (c)(1),
(2), (4) Date: Nov. 9, 2012

(87) PCT Pub. No.: WO2011/141491

PCT Pub. Date: Nov. 17, 2011

(65) Prior Publication Data

US 2013/0056503 A1 Mar. 7, 2013

(30) Foreign Application Priority Data

May 11, 2010 (DE) ..... 10 2010 016 886

(51) Int. Cl.
*B67D 3/00* (2006.01)

(52) U.S. Cl.
USPC ..... 222/522; 222/505; 222/526; 222/532

(58) Field of Classification Search
USPC ..... 222/522, 525, 526, 505, 509, 531–532, 222/537, 559
See application file for complete search history.

(56) References Cited

U.S. PATENT DOCUMENTS

| | | | | | |
|---|---|---|---|---|---|
| 2,790,582 | A | * | 4/1957 | Halpern | 222/481.5 |
| 2,919,057 | A | * | 12/1959 | Halpern | 222/484 |
| 3,884,390 | A | * | 5/1975 | Hazard | 222/149 |
| 4,408,700 | A | * | 10/1983 | Fillmore et al. | 222/153.06 |
| 4,779,774 | A | * | 10/1988 | Morel | 222/522 |
| 5,377,870 | A | * | 1/1995 | Morel | 222/23 |
| 5,547,111 | A | * | 8/1996 | Geiger et al. | 222/505 |
| 5,961,001 | A | * | 10/1999 | Davis et al. | 222/153.06 |
| 6,364,178 | B1 | * | 4/2002 | Paczonay | 222/522 |
| 7,874,461 | B2 | * | 1/2011 | Bae | 222/153.13 |
| 8,439,230 | B2 | * | 5/2013 | Hagen | 222/153.13 |
| 2011/0031282 | A1 | | 2/2011 | Hagen | |

FOREIGN PATENT DOCUMENTS

| | | |
|---|---|---|
| CH | 582 102 | 11/1976 |
| WO | WO 2009/127651 | 10/2009 |

OTHER PUBLICATIONS

International Search Report of PCT/EP2011/057572, Aug. 24, 2011.

* cited by examiner

*Primary Examiner* — Frederick C Nicolas
(74) *Attorney, Agent, or Firm* — Collard & Roe, P.C.

(57) ABSTRACT

A dispenser for dispensing liquid or paste-like substances includes a dispenser head with a mouth opening. At least a part of the dispenser head with the mouth opening is extendable and retractable with respect to a surrounding housing wall. A surface that comes in contact with the mouth opening or with an end face region of a protruding wall formed so as to surround the mouth opening encloses an acute angle with a vertical in a cross-section in which the surface appears as a line, and, in the retracted state, this region is in contact with an identically-formed support surface on the housing wall which faces the mouth opening or the end face region.

3 Claims, 4 Drawing Sheets

DISPENSER

CROSS REFERENCE TO RELATED APPLICATIONS

This application is the National Stage of PCT/EP2011/057572 filed on May 11, 2011, which claims priority under 35 U.S.C. §119 of German Application No. 10 2010 016 886.6 filed on May 11, 2010, the disclosure of which is incorporated by reference. The international application under PCT article 21(2) was not published in English.

BACKGROUND OF THE INVENTION

1. Field of the Invention

The invention relates to a dispenser for dispensing liquid or paste-like substances, comprising a dispenser head having a mouth opening, at least a part of the dispenser head that has the mouth opening being extendable and retractable with respect to a surrounding housing wall.

2. Description of the Related Art

A dispenser of this kind is known for example from WO 2009/127651 A1.

The displaceable dispenser head, in which the mouth opening or at least the part of the dispenser head that has the mouth opening, is, in the retracted state, behind a concealing housing wall, is valued as being aesthetically appealing. However, there can be problems in regard to sealing. The shelf life of the substance may be adversely affected by this.

SUMMARY OF THE INVENTION

A dispenser is known from CH 582102 A5 in which the mouth opening is concealed in the extended state of the dispenser head. In addition, the sealing in this extended state of the dispenser head is not satisfactory, in particular also in respect of the constructional complexity.

Proceeding from the state of the art mentioned, it is an object of the invention to provide the dispenser mentioned at the beginning in an advantageous manner as regards a more favorable sealing in the retracted state of the dispenser head.

This object is met by the subject matter of Claim 1 in that a surface that comes in contact with the mouth opening, or which surface comes in contact with an end face region of a protruding wall that is formed so as to surround the mouth opening, encloses an acute angle, in a cross-section in which the surface appears as a line, with a retraction direction of the dispenser head, and, in the retracted state, the mouth opening or the end face region is in contact with an identically-formed support surface on the housing wall, which support surface faces the mouth opening or the end face region, and that the dispenser head or the part of the dispenser head that is opposite the surface is, in the retracted state, in pressing contact with a counter-surface of a housing wall that is in overlap there, in the retracted state, and is U-shaped in this region.

When the dispenser head or the dispenser head part is retracted, the mouth opening or a wall portion surrounding the mouth opening travels vertically onto the support wall. Both the support wall as well as the mouth opening or the protruding wall surrounding the mouth opening are formed to slope in cross-section, preferably aligned in the same direction. Vertically, they are in overlap. In the contact state, a sealing surface support can thus be achieved.

The dispenser head, which is preferably configured in a circular shape in plan view at least in the region of the mouth opening, or the dispenser head part, is more preferably configured to be planar, even though in deviation from this, a dome-shaped configuration is also possible.

Here, it is not essential for the wall region which forms the mouth opening on the dispenser head to be directly in sealing contact on the support wall of the housing wall in the retracted state. There may also be in contact—only—a wall that surrounds the mouth opening, for example in the manner of a bead.

The part of the dispenser head which is opposite the surface is, in the retracted state, in pressing contact with a counter-surface (inner surface) of a housing wall that is in overlap there, in the retracted state. By virtue of this pressing contact, there is achieved also, at the same time, a sealing pressing contact in the region of the mouth opening. The housing wall may be the same [wall], which also forms the support wall. Preferably this is, in this regard, a circular annularly-shaped housing wall that completely surrounds the entire dispenser head.

It is also preferable that the pressing contact is effected in the retracted state by a displacement of the dispenser head achieved in the region of the mouth opening as a result of an excess length.

The dispenser head is for example tilted at the same time, at least in this portion of its retraction region.

The invention is further explained below with reference to the accompanying drawings, which, however, only show an exemplary embodiment. The figures show the following:

DETAILED DESCRIPTION OF THE PREFERRED EMBODIMENTS

Figure 1:
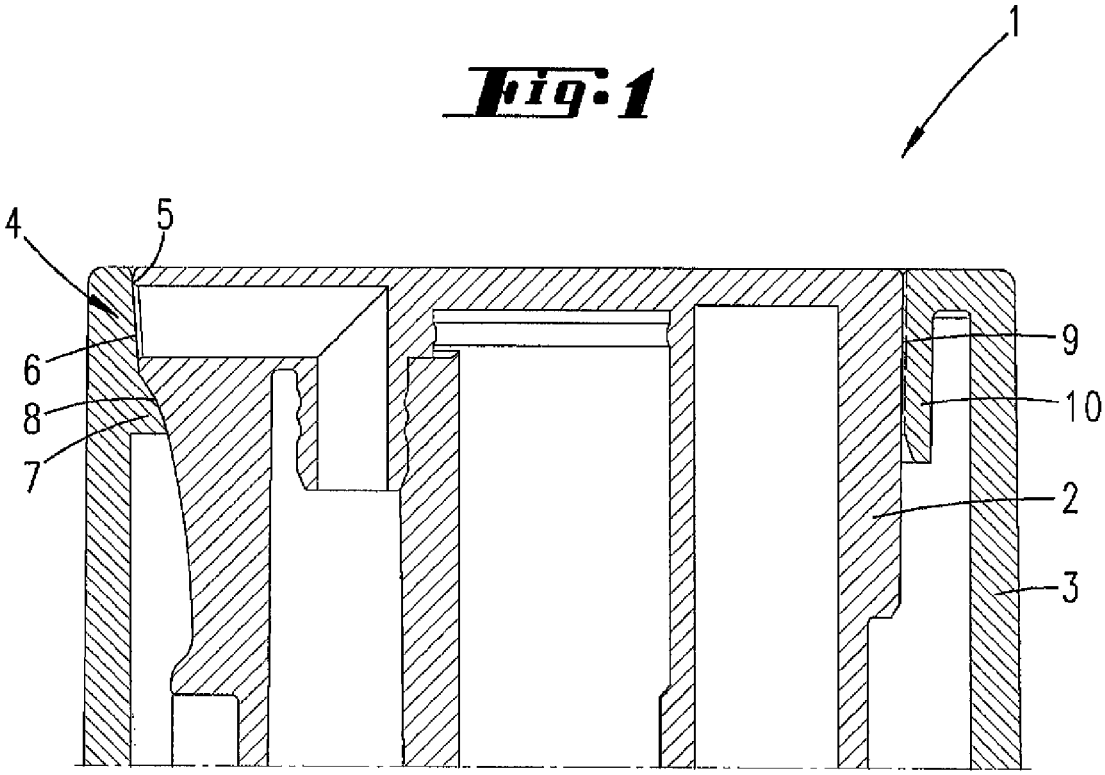
FIG. 1 shows a cross-section through the dispenser in the region of the dispenser head, in the retracted state.

Shown and described is a dispenser 1 that has a dispenser head 2 and a housing wall 3 that surrounds the dispenser head 2 in the retracted state according to FIG. 1.

The dispenser head 2 is part of a pump chamber, as is apparent in further detail from WO 2009/127651 A1, already mentioned in the introduction. Reference is made to this for further explanation.

The dispenser head 2 has a mouth opening 4, which, in the exemplary embodiment, is surrounded by a sealing bead 5. The sealing bead 5 engages, in the retracted state according to FIG. 1, against a support surface 6 formed on the inner side of the housing wall 3. Overrun downward is in addition prevented by a stop projection 7 formed below the support surface 6, on which, in the case of overrun, an underside surface 8 of the dispenser head 2, formed below the mouth opening 4, would abut.

Figure 2:
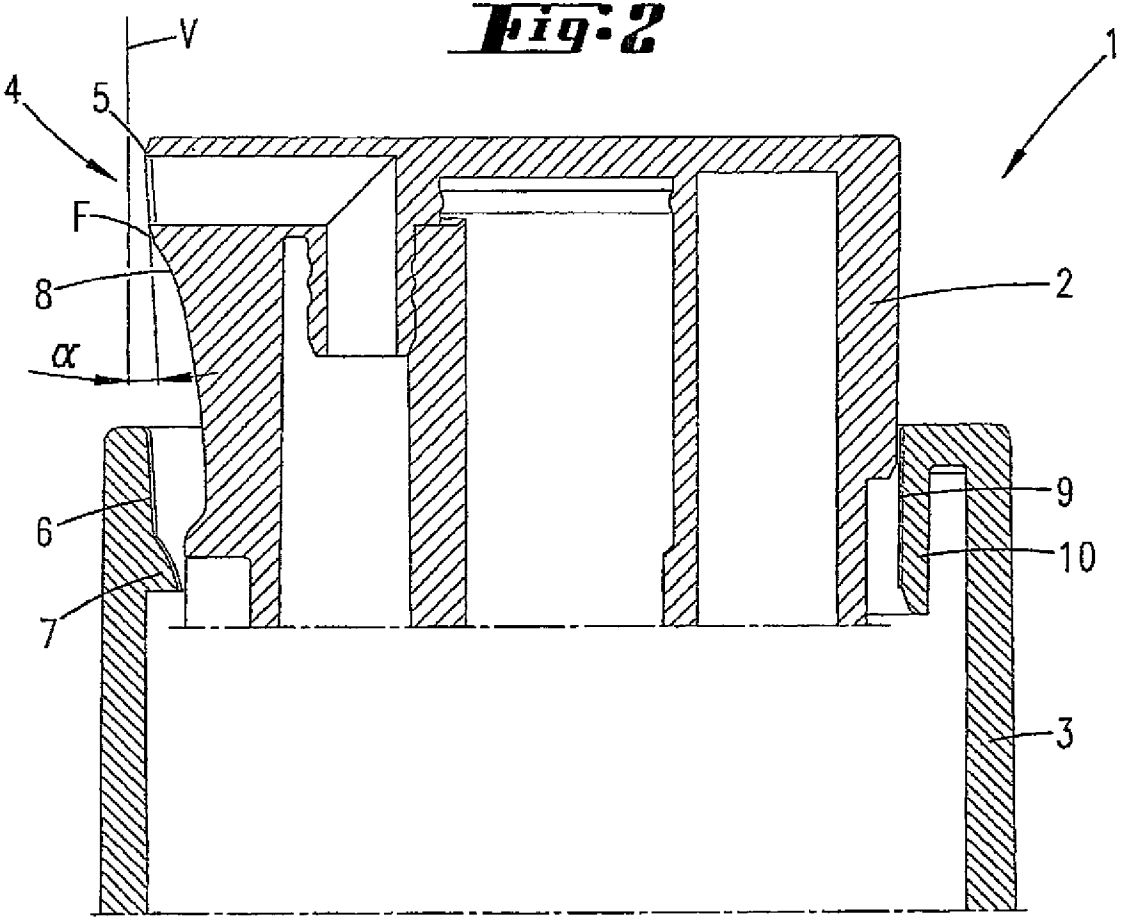
FIG. 2 shows an illustration corresponding to FIG. 1 in the extended state.
Figure 3:
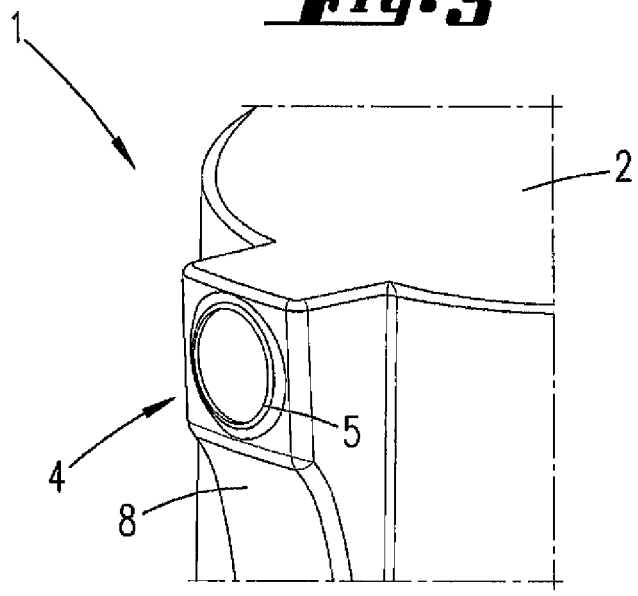
FIG. 3 shows a perspective view of the dispenser head in the region of the dispensing opening.

A surface F, which contacts the bead 5 in the cross-section shown in FIG. 2, encloses an acute angle $\alpha$ with a vertical V. The angle $\alpha$ is preferably more than 0.1°, up to for example 10°. All intermediate values, in particular in steps of 1/10°, on the one hand to the limit of the mentioned range boundaries from below and/or above, alternatively or in addition however also in respect of the disclosure of one or more singular values in the range mentioned, are hereby also included in the disclosure.

The support surface 6 is, in the exemplary embodiment, preferably configured similarly to the surface F. Both surfaces may extend, in plan view, in the shape of a circular segment or a dome. They may however also run in a straight line.

While the angle $\alpha$ opens downwardly, the support surface 6 can be seen to extend with an upwardly-opening angle relative to a vertical V.

Diametrically opposite the support surface 6, the dispenser head 2 is, in the retracted state, in pressing contact against a counter-surface 9 of the housing wall 3, which is—also—formed in this region. The counter-surface 9 is furthermore provided in a region of the housing wall 3 which is configured in the shape of a U. If, as is preferred, the contact is in the unsupported limb 10 of the wall that is configured in the shape of a U, a certain spring effect is in addition achieved.

The contact on the counter-surface 9 can be effected by the downward travel of the dispenser head 2, in that there is a certain excess length, i.e. in the vertical projection out of the extended position of FIG. 2 into the retracted position according to FIG. 1, there would be an overlap with respect to the surface F and the counter-surface 9. The contact may however also be achieved by a corresponding bead formation on the counter-surface 9.

The movement of the dispenser head 2, and thus in particular also the downward travel, is preferably effected by a sliding guide. For this, a slideway can be formed in a fixed outer sleeve, in which there runs a sliding block formed on the dispenser head, as is described in WO 2009/127651 A1 mentioned at the beginning, to which in this regard in particular, reference is made once again, also in particular for inclusion of this disclosure adverted to here in the present application, also for the purpose of incorporating features of this already known application in claims of the present application. This slideway may in particular more preferably be composed of an oblique portion, a lower retaining portion, and an upper retaining portion. In the present context, the lower retaining portion is in particular of importance, since by this an automatically non-opening, clamping sealing contact of the retracted dispenser head can be advantageously achieved, namely sealing contact with respect to the dispenser mouth or an encircling bead on the housing wall, as described above.

Alternatively or in addition, this clamping securing may also be achieved by latching, for example.

More preferably, a certain tilting of the dispenser head 2 in the retracted state may also be achieved by the configuration in question, for example by the formation of the bead. Furthermore, corresponding overlaps or a bead may however also be formed on both sides, so that by strictly vertical movement, the mentioned clamping readily results.

Figure 4:
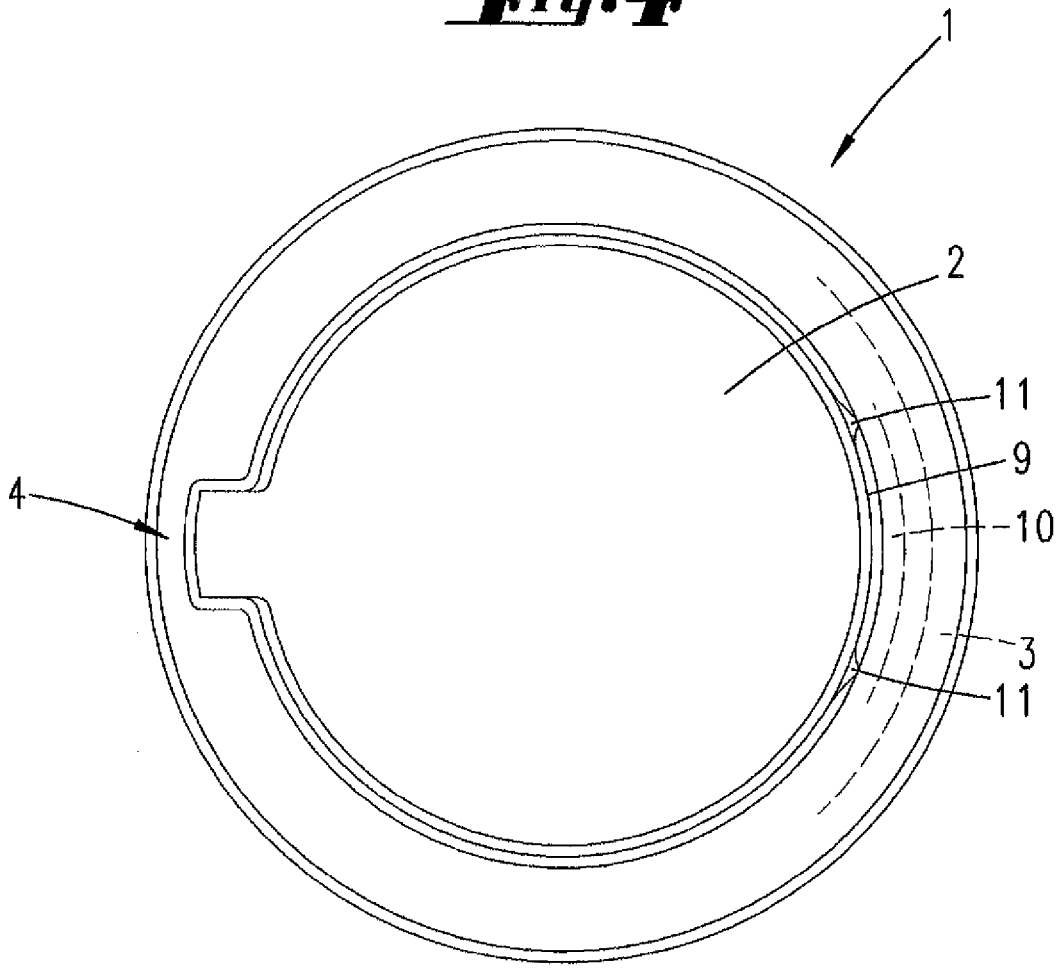
FIG. 4 shows a view from above of the dispenser with the dispenser head extended.
Figure 5:
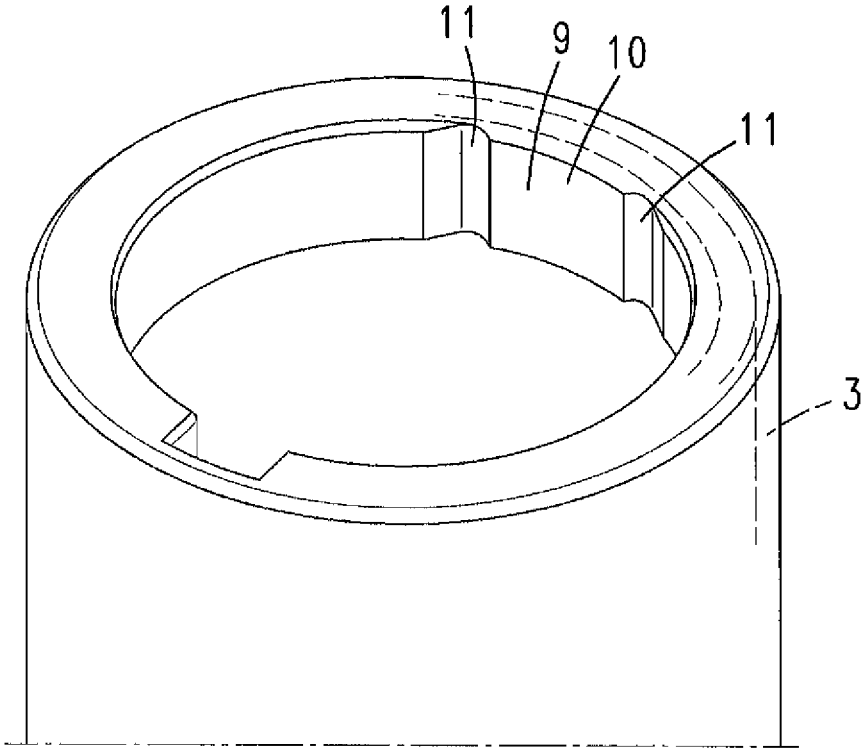
FIG. 5 shows a perspective view of the housing wall with the dispenser head removed.

In the exemplary embodiment, it is also preferably provided, as is shown in FIGS. 4 and 5 in particular, that the counter-surface 9 is separated with respect to the rest of the extent of the wall, which is here formed to be circular in plan view, by notches 11 which are displaced with respect to a diametrically opposite position relative to the mouth opening 4. This allows, in an advantageous manner in addition, the desired contact (FIG. 4 shows the extended state) to be achieved.

The mouth bead 5 may in principle also consist of a soft plastics, introduced for example in the two-component injection method, while the dispenser head 2 may otherwise consist of hard plastics. In the exemplary embodiment, the mouth bead 5 may however also consist of a hard plastics. The pressing contact mentioned here allows sufficiently advantageous sealing in a readily achievable manner even in the case when the interaction is between hard plastics components. Also the housing wall 3 consists preferably of a hard plastics. In principle, the mentioned support surface 6 of the housing wall 3 may however also consist of a soft plastics, for example also introduced here in the two-component injection method.

The invention claimed is:

1. Dispenser for dispensing liquid or paste-like substances, comprising a dispenser head having a mouth opening, at least a part of the dispenser head that has the mouth opening being extendable and retractable with respect to a surrounding housing wall, wherein a surface that comes in contact with the mouth opening, or with an end face region of a protruding wall that is formed so as to surround the mouth opening, encloses an acute angle, in a cross-section in which the surface appears as a line, with a retraction direction of the dispenser head, and, in a retracted state, the mouth opening or the end face region is in contact with an identically-formed support surface on the housing wall facing the mouth opening or the end face region, and wherein the dispenser head or the part of the dispenser head that is opposite the surface is, in the retracted state, in pressing contact with a counter-surface of the housing wall that is in overlap there, in the retracted state, and is U-shaped in a region of the overlap.

2. Dispenser according to claim 1, wherein the pressing contact is effected by a displacement of the dispenser head achieved in the region of the mouth opening as a result of an excess length.

3. Dispenser according to claim 1, wherein the mouth opening is surrounded by a sealing bead.

* * * * *